United States Patent [19]

Hage et al.

[11] 4,104,838

[45] Aug. 8, 1978

[54] PORTABLE WALL ASSEMBLY

[75] Inventors: C. Herbert Hage, Poland, Ohio; Robert J. Welch, West Chicago, Ill.; Gabriel Goulish, Youngstown, Ohio

[73] Assignee: GF Business Equipment, Inc., Youngstown, Ohio

[21] Appl. No.: 797,628

[22] Filed: May 17, 1977

[51] Int. Cl.[2] ..... E04H 1/00

[52] U.S. Cl. ..... 52/239; 52/282; 160/135

[58] Field of Search ..... 52/239, 70, 71, 282, 52/238, 495, 122, 126; 160/351, 135

[56] References Cited

U.S. PATENT DOCUMENTS

| | | | |
|---|---|---|---|
| 3,762,116 | 10/1973 | Anderson et al. | 52/239 |
| 3,766,692 | 10/1973 | Stark et al. | 52/239 X |
| 3,809,142 | 5/1974 | Bleeker | 52/239 |
| 3,871,153 | 3/1975 | Birum, Jr. | 52/716 X |
| 3,877,191 | 4/1975 | Munsey | 52/239 X |
| 3,895,676 | 7/1975 | Bales et al. | 160/135 |
| 3,971,182 | 7/1976 | Donahue et al. | 52/239 X |
| 3,987,836 | 10/1976 | Le May | 160/135 |
| 4,021,973 | 5/1977 | Hegg et al. | 52/239 X |

*Primary Examiner*—Ernest R. Purser
*Assistant Examiner*—Carl D. Friedman
*Attorney, Agent, or Firm*—Emory L. Groff, Jr.

[57] ABSTRACT

A wall assembly includes one or more panels each supported at its end edges by means of a removably attached post having releasable retainer means at the top and bottom thereof engageable with top and bottom mounting clips carried by each panel end edge. Each clip is provided with a leg insertable and transversely secured within the free ends respectively of an edge channel attached to each panel end edge while a tongue projects outwardly from each clip and extends inwardly toward the medial portion of the post. Fastener means associated with each top and bottom retainer means is activated to securely clamp each clip tongue within the respective end of the post to rigidly connect the panel thereto. Removable force-fitting trim means is attachable to the panel top and top retainer means to provide a smooth, planar construction along the top of the wall assembly.

19 Claims, 6 Drawing Figures

PORTABLE WALL ASSEMBLY

This invention relates generally to portable wall assemblies most commonly utilized in forming office partition systems, and more particularly, to a wall assembly comprising a plurality of individual partitions or screen panels having improved means providing a rigid yet removable connection between the edges of the panels and an adjacent intermediate vertical supporting post by means of a fixed top mounting clip carried by the edge of each panel and a bottom mounting clip which is normally a separate loose component prior to the assembly operation, but which becomes locked in place to retain the assembled components in a thoroughly secure relationship.

Wall assemblies comprising adjustably connected partition elements are generally well known, yet many shortcomings have been experienced when utilizing certain of the presently available devices. In many prior instances a plurality of intricate compounds are required which results in an excessive manufacturing cost factor and often requires semi-skilled personnel to effect the final assembly thereof. On the other hand, by the present arrangement an extremely simple construction is provided wherein a central mounting post or standard serves as the connecting means for joining together two, three or four panels of similar construction into a rigid assembly without the employment of any tools other than a simple screwdriver and possibly a wrench.

From the following description it will be appreciated that the concept of the instant invention is applicable both when utilizing a mounting post of circular or square cross-section. In the case of a circular supporting post, it will be possible to vary the angular disposition between a plurality of panels which are connected to any one such post between a range of 90° and 180° from one another, while when using a square mounting post with the present invention, any one or more of the four sides thereof may serve to support a corresponding number of panels to provide either a straight line partition assembly or a right angular partition assembly or a combination of the foregoing.

The present invention will be understood to be an improvement over the portable wall assembly as disclosed in U.S. Pat. No. 3,971,182 issued July 27, 1976, to the assignee of the instant invention. In the referenced patent, an assembly is disclosed including a pair of hook-type mounting clips permanently affixed at the top and bottom of each panel edge respectively, and wherein each clip is provided with a downwardly projecting tongue. The assembly or attachment is achieved by lowering a panel so as to simultaneously dispose the top mounting clip tongue into the interior of the top of the mounting post and the bottom clip tongue into an upwardly directed groove provided by a cap member depending from the bottom of the mounting post and thereafter locking action is achieved upon the tightening of a compressible and expandable resilient element inserted into the top of the mounting post. The improvement offered by the assembly of the present invention will be readily apparent as the description following hereinafter is considered.

Accordingly, one of the primary objects of the present invention is to provide an improved wall assembly including a plurality of partitions or panels at least two of which are connected by means of a common post element in a manner allowing of various selected angular relationships therebetween.

Another object of the present invention is to provide an improved wall assembly including a panel having a pair of mounting clips associated with the top and bottom of at least one end edge thereof and cooperating with a vertical post having removable locking means operable to rigidly secure each of the clips relative the post.

A further object of the present invention is to provide an improved wall assembly including a panel having a fixed downwardly directed hook member engageable within the top of a post and cooperating with a removable mounting clip having an upwardy directed hook portion insertable within the bottom of the post, together with screw fastened retainer means for locking each of the hook members relative the post.

Still another object of the present invention is to provide a improved wall assembly including a plurality of panels connected to post members by retainer means and having forced-fitting removable trim members attached to the top of the panels and the retainer means.

With these and other objects in view which will more readily appear as the nature of the invention is better understood, the invention consists in the novel construction, combination and arrangement of parts hereinafter more fully described, illustrated and claimed.

A preferred and practical embodiment of the invention is shown in the accompanying drawings, in which.

Similar reference characters designate corresponding parts throughout the several figures of the drawings.

Figure 3:
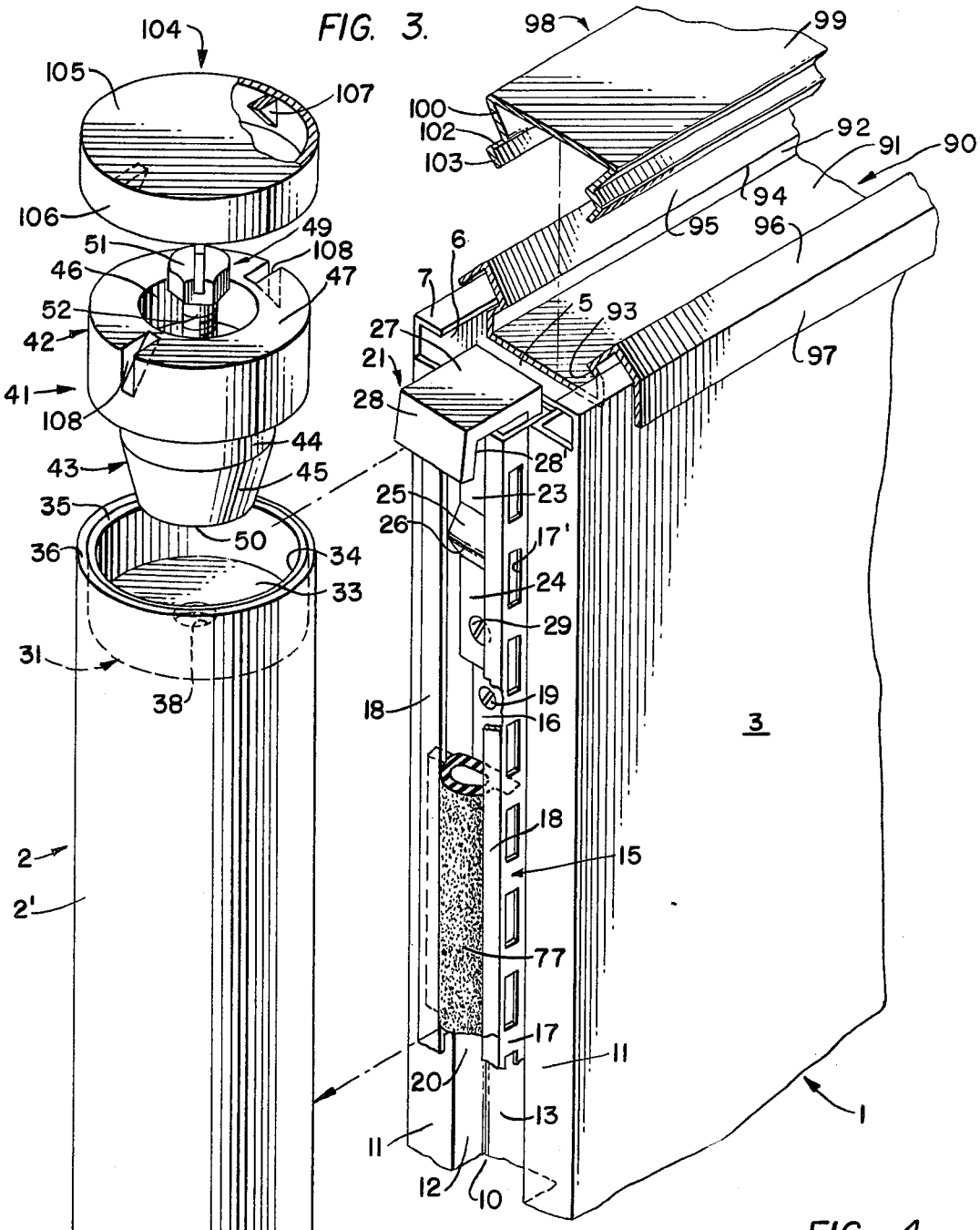
FIG. 3 is an exploded top perspective view of one panel and the post shown in FIGS. 1 and 2.

Referring now to the drawings, particularly FIG. 3, the present invention will be seen to include a screen partition or panel, generally designated 1, having means enabling rigid yet adjustable attachment to a post or upright standard, generally designated 2. Insofar as the instant invention is concerned, the construction of the interior of the panel 1 is immaterial, while the crux of the invention resides in the construction associated with the vertical end edges of the panel and the referenced post 2. Although only one end edge of a panel 1 is illustrated, it will be understood that the other opposite end edge will include the same construction as shown in the drawings so that any one panel 1 may be associated with a plurality of similarly constructed panels with one of the posts 2 disposed intermediate each pair of panels as well as at the outside edge of each of the end-most panels.

Each panel 1 includes a pair of outer faces 3 joined, at least at the top, by means of a top channel member 4, the latter of which will be seen to include a bottom wall 5 bounded by a pair of vertical side walls 6—6 which in turn are joined to the top of the outer faces 3 by means of top walls 7–7, such that a depressed groove or channel 8 is formed throughout the longitudinal extent of the panel 1. Each vertical end 9 of the panel is provided with an edge groove 10 extending the vertical height of the panel and formed intermediate the pair of transverse panel edge strips 11—11 and bounded by the inward walls 12—12, each terminating in a transverse flange identified as a first panel edge flange 13 and a second panel edge flange 14 and, as will be seen most clearly from FIG. 4, these two flanges are disposed in an overlapping arrangement. Disposed within this panel edge groove 10 is an edge channel 15 having a base 16 forming a close-fit within the groove 10 and provided with a pair of side walls 17—17 projecting outwardly from the transverse plane of the panel edge strips 11, and terminating in the edge channel inturned flanges 18—18. The edge channel 15 will be understood to extend the entire vertical height of the panel 1 and is permanently affixed to the panel end 9 within its groove 10 by means of one or more edge channel attachment screws 19 passed through the edge channel base 16 and the two overlapping panel edge flanges 13 and 14 as shown both in FIGS. 2 and 4 of the drawings.

The two edge channel side walls 17—17 may be provided with a plurality of vertical spaced elongated slots 17′ for the reception of suitable brackets (not shown) in order to provide for the attachment of shelving or other associated components desired to be utilized in conjunction with the present wall assembly, which feature is generally well known in this art.

Figure 2:
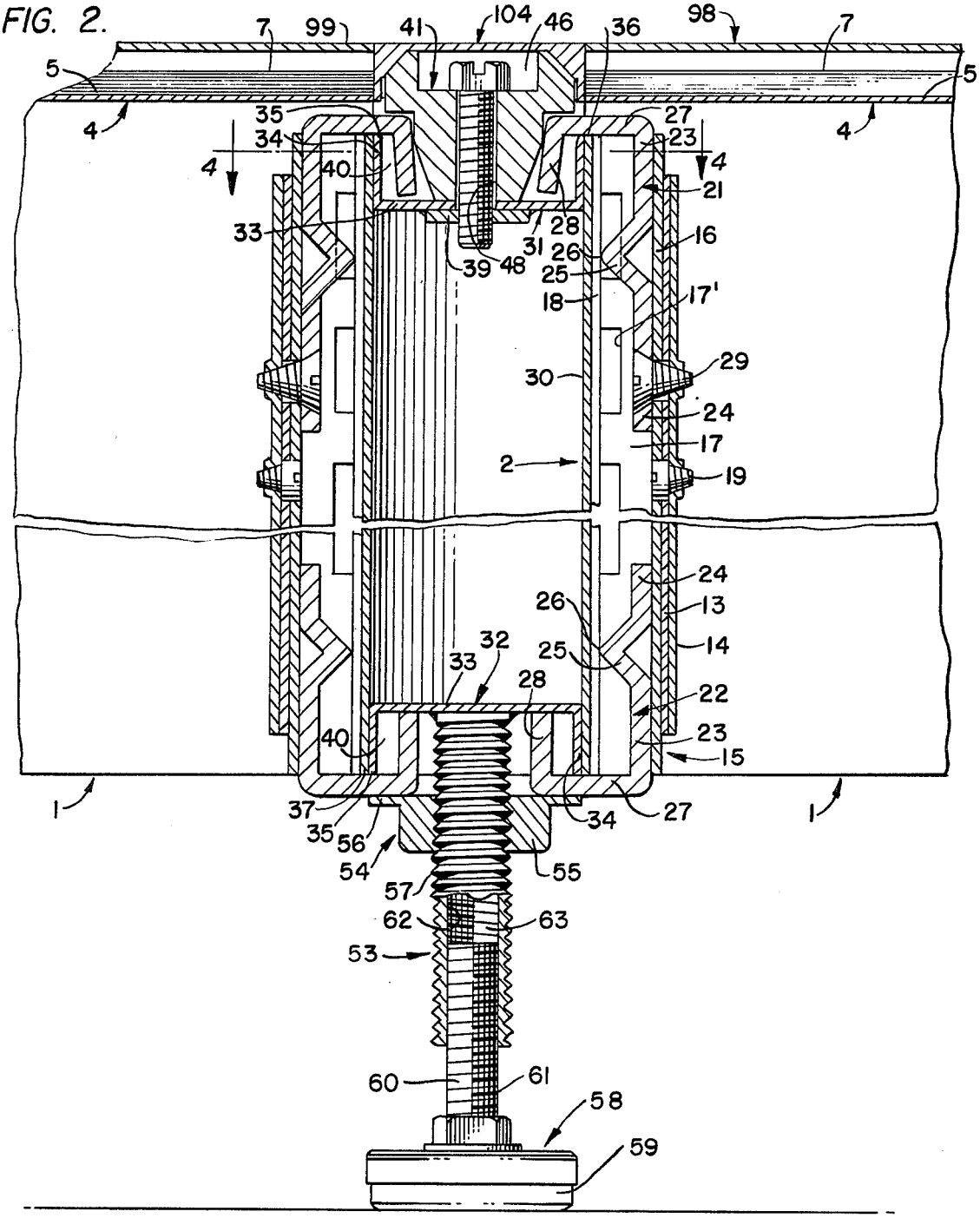
FIG. 2 is a vertical sectional view taken along the line 2—2 of FIG. 1.
Figure 4:
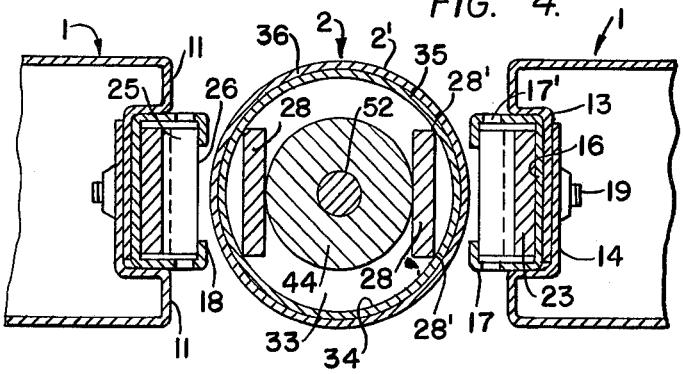
FIG. 4 is a horizontal sectional view taken along the line 4—4 of FIG. 2.

Adapted to cooperate with the cavity 20 formed by the base 16, side walls 17 and inturned flanges 18 of the edge channel 15 is a top mounting clip 21 and a bottom mounting clip 22, the latter of which appears in FIG. 2 of the drawings. These two mounting clips are of substantially similar construction and each will be seen to include a mounting leg comprising a first portion 23 and a distal second portion 24. An offset projection 25 is formed intermediate the mounting clip first and second portions and is formed so that the extent of the offset is sufficient to provide a very close sliding friction fit when the mounting legs of the clip are inserted within the cavity 20 from the two free ends of the edge channel 15, it being noted that when in the installed position of FIG. 2 of the drawings the rear of the mounting legs will be flush with the exposed face of the edge channel base 16, while the forward edge 26 of each mounting clip offset projection 25 tightly engages the inner surface of the two edge channel inturned flanges 18–18 as shown in FIGS. 2 and 4 of the drawings.

The end of each mounting clip first portion 23 is connected to a horizontally disposed arm 27 which projects outwardly a substantial distance beyond the transverse plane of the edge channel inturned flanges 18 and terminates in a substantially vertically disposed tongue 28. With the above construction in mind, it will be appreciated that the lateral extent of both of the mounting clips 21 and 22 is substantially greater than the lateral distance between the distal portions of the two opposed edge channel inturned flanges 18, so that at all times the edges 26 of the mounting clip offset projections 25 will remain captive therebehind. As previously indicated, the top mounting clip 21 is preferably permanently affixed relative the panel edge channel 15 and accordingly an appropriate clip attaching screw 29 is passed through the top clip mounting leg second portion 24, the edge channel base 16, the two overlapping panel edge flanges 13–14 and threadably engages at least the innermost second panel edge flange 14.

Figure 1:
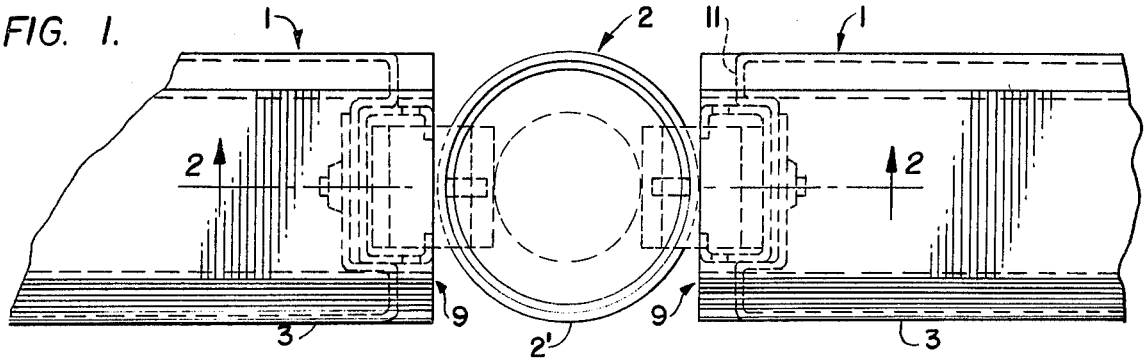
FIG. 1 is a fragmentary top plan view of one form of the present invention.

The construction of the posts 2 and the retainer elements associated therewith serving to secure the above described panels 1 thereto will now be discussed. FIGS. 1–3 of the drawings illustrate a cylindrical post 2 having a circular inner periphery 30 within which is disposed a top cup or insert 31 at the upper end thereof and a bottom cup or insert 32 at the lower end thereof. In this embodiment both inserts 31 and 32 are cup-shaped and include a horizontal wall 33 surrounded by a cylindrical side wall 34 having an outer edge 35 fixedly and flushly disposed relative the post top edge 36 and post bottom edge 37, respectively. Both of the inserts 31 and 32 are suitably permanently affixed in the position illustrated in FIG. 2 of the drawings such as by an adhesive or by welding. The top insert 31 is provided with a central hole 38 associated with a captive nut 39 attached to its undersurface, the purpose of which will become apparent hereinafter.

With the foregoing structure in mind it will be seen that each of the inserts 31, 32 provides a cavity 40 opening outwardly toward the post top edge 36 or bottom edge 37 respectively, and it is within the confines of these cavities that the tongues 28 of the top and bottom mounting clips 21–22 are intended to be disposed in order to support and retain a panel 1 affixed to the post 2. Such an assembly is achieved by initially lowering the tongue 28 of a panel top mounting clip 21 into the cavity 40 of the top insert 31, at which point it will be understood that the plane formed by the edge channel inturned flanges 18—18 will be substantially tangent to the outer periphery 2′ of the post 2 as shown in FIG. 4 of the drawings. This relationship is assured by the formation of the mounting clip tongue 28 with a lateral extent selected to guarantee the illustrated relative positioning when the rear tongue edges 28′—28′ are forcefully urged against the inner periphery of the insert side wall 34.

The thus positioned components are secured in the assembled condition by means of a retainer, generally designated 41 and which will be seen to include a cylindrical upper body 42 joined to a lower body 43, the latter of which includes a reduced diameter cylindrical segment 44 connected to a lower-most conical segment 45. A central recess 46 is concentrically formed within the top wall 47 of the retainer and cooperates with a central bore 48 extending throughout the body of the retainer, to receive a fastener 49. Upon the disposition of the top mounting clip tongue 28 into the confines of the top insert cavity 40, the retainer 41 is lowered from the position shown in FIG. 2 of the drawings until the retainer bottom wall 50 abuts the insert horizontal wall 33, after which the fastener 49 is manipulated such as by its head 51 in order to engage its threaded shank 52 with the fixed nut 39 and the components will then appear as shown in the upper portion of FIG. 2 of the drawings.

Following the installation and securing of the panel top mounting clip 21, it will then be possible to install the bottom mounting clip 22 which, it will be recalled, is not normally carried by the panel end edge prior to the installation procedure.

A screw/stud 53 having its top permanently affixed to the center of the bottom insert horizontal wall 33 serves to support adjustable means utilized to securely lock and retain the bottom mounting clip 22 after its mounting leg portions 23 and 24 have been inserted into the edge channel cavity 20 into its fully seated position, wherein the arm 27 abuts the panel bottom edge 37 and the tongue 28 is disposed within the bottom insert cavity 40 as shown in FIG. 2 of the drawings. The referenced bottom clip retainer means comprises a combination nut/washer 54 preferably including a unitary member provided with a lower nut 55 and an upper flat washer 56. The nut 55 engages with mating exterior threads 57 extending the full length of the screw/stud 53 so that following a full seating of the bottom mounting clip 22 as shown in FIG. 2 of the drawings, the combination nut/washer 54 may be tightened in order to draw the flat washer 56 upwardly into abutting engagement with the juxtaposed surface of the clip member 27 so as to forcefully retain the mounting clip in the assembled position. Quite obviously, the diameter of the washer 56 must be sufficient to at least extend into underlying arrangement with the mounting clip arm 27.

The above described screw/stud 53 serves not only as means for cooperating with the clamping nut/washer retainer assembly 54 but also to support a suitable adjustable glide, generally designated 58. The glide includes a foot 59 joined to a screw 60 having exterior threads 61 cooperating with internal threads 62 formed in the central bore 63 of the screw/stud 53.

Figure 5:
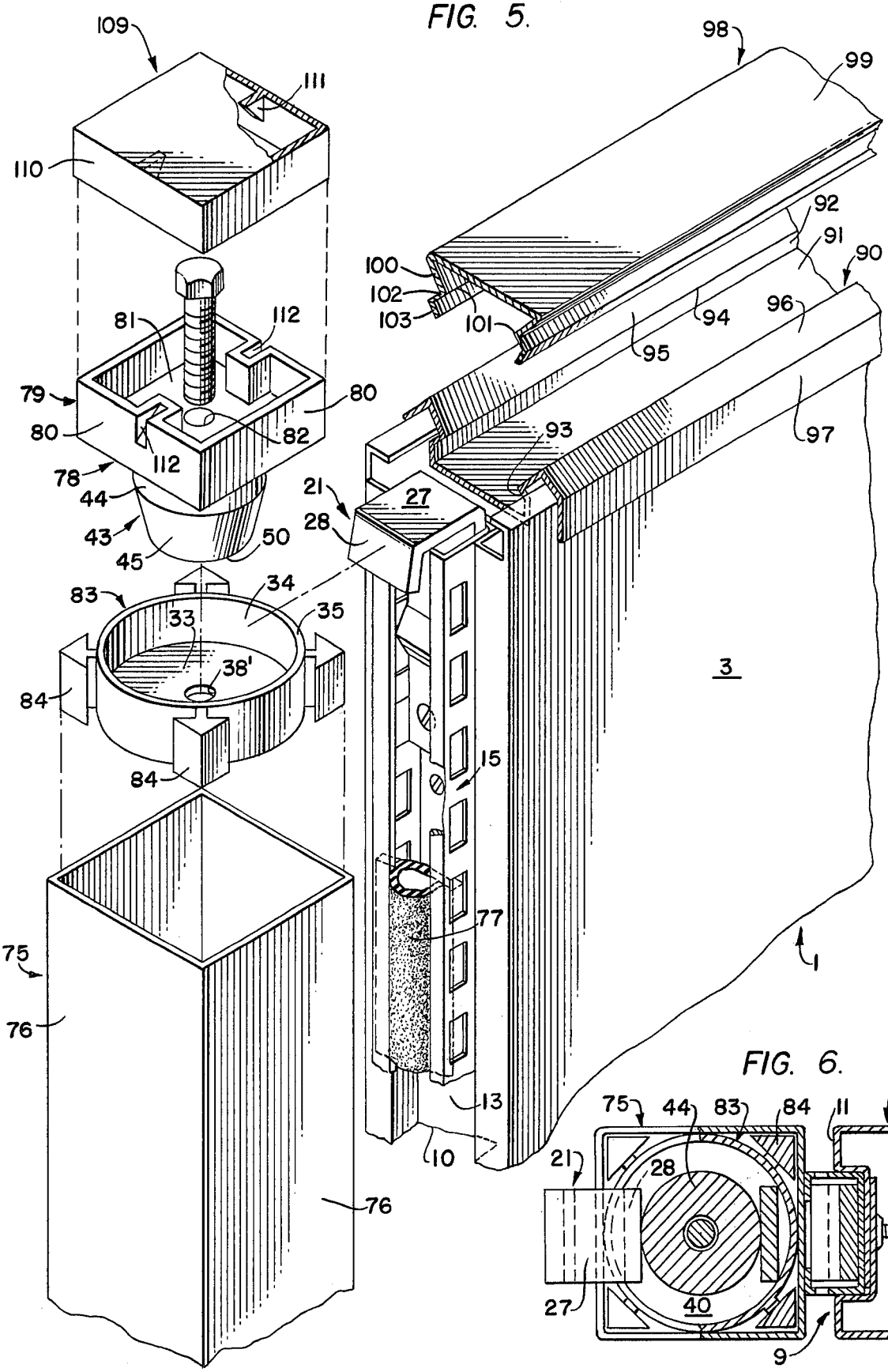
FIG. 5 is an exploded top perspective view of an alternate form of the present invention.
Figure 6:
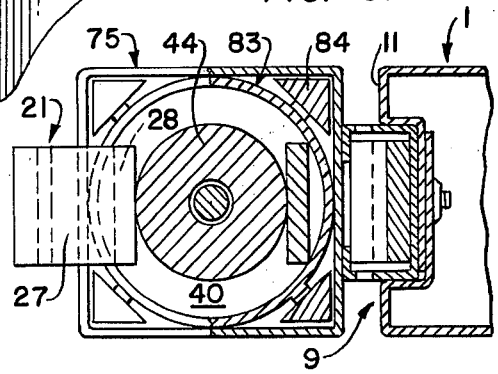
FIG. 6 is a horizontal sectional view similar to FIG. 4 but illustrates the assembled position of the components shown in the embodiment of FIG. 5.

FIGS. 5 and 6 of the drawings illustrate another embodiment of the present invention wherein a square or rectangular post 75 having a plurality of planar side walls 76 is substituted for the circular post 2 associated with the preceding embodiment. The advantage associated with the use of a square post 75 should be quite obvious. When it is desired to construct a wall assembly comprising a plurality of axially aligned panels 2, the vertical ends 9 of the longitudinally aligned panels are all connected to oppositely disposed side walls 76–76 of the respective intermediate posts 75, thereby ensuring a perfectly straight wall assembly. Additionally, it is a simple matter to ensure that no light line exists at the point of juncture between each panel and the posts 75 inasmuch as the mounting clips 21 and 22 will hold the transverse planar surfaces of the edge channel inturned flanges 18—18 in flush engagement with the planar surface of the juxtaposed post side walls 76. At this point it will be mentioned that a flexible insert 77 is preferably disposed within the confines of the edge channel cavity 20 to completely mask any light lines which would otherwise be visible from one side of the wall assembly to the other in view of the bracket mounting slots 17' formed in the edge channel side walls 17—17.

The only limitation inherent with the use of a square post 75 is that the panels 2 can only be connected in a linear manner or at 90° with respect to one another, yet this restriction is seldom a handicap inasmuch as the majority of installations involve only 90° and 180° adjacent panel connections.

In this second embodiment the top retainer, generally designated 78, includes a lower body 43 having an upper cylindrical segment 44 and lower conical segment 45 similar to the corresponding elements associated with the previously described retainer 41, yet the topmost portion of the retainer 78 is modified to provide an upper body 79 having planar side walls 80 arranged in a square configuration substantially congruent with the cross sectional configuration of the associated support post 75. The four side walls 80 define a recess 81 having a central hole 82 extending throughout the height of the retainer 78 for the reception of a threaded fastener 49 intended to serve the same purpose as this fastener does in the first described embodiment. The cup or insert 83 disposed within the upper portion of the post 75 may be provided with four equi-spaced fingers 84 adapted to closely fit within the four corners of the post to increase the stability and to facilitate the permanent anchoring of the insert with respect to the post.

The manner of attaching a panel 2 to a square post 75 is identical to that previously described in connection with the first mentioned embodiment and it will be understood that the bottom of the post is provided with structure identical to that shown in the lower portion of FIG. 2 of the drawings.

Suitable trim members are provided to offer a smooth, substantially continuous surface across the top of the panel 2 and the respective retainers 41 and 78. As previously mentioned, the top portion of each panel 2 is formed with a longitudinally extending groove or channel 8 and this channel serves to receive an elongated base trim member, generally designated 90, and comprising a bottom wall 91 extending transversely across the panel channel bottom wall 5 and from which project upwardly along both sides thereof of the inside walls 92—92. These latter walls preferably only extend upwardly a portion of the height of the panel channel side walls 6 and are joined to an inwardly directed portion 93 terminating in a locking edge 94, which in turn is connected to an inside angled wall 95 extending upwardly and outwardly to a point above the panel top walls 7 as shown most clearly in FIGS. 3 and 5 of the drawings. An outside angled wall 96 extends downwardly and outwardly from the uppermost portion of the inside angled walls 95 to a point juxtaposed the intersection of the panel outer face 3 and panel top wall 7 and from there the base trim member extends downwardly to provide an outer flange 97 terminating well below the top edge of the panel outer face 3. The base trim member 90 may be constructed of any suitable metallic or plastic composition possessing at least limited flexibility and by forming the base trim member bottom wall member 91 of an appropriate transverse extent and regulating the distance between the inside wall 92 and its juxtaposed outer flange 97, it will be obvious that a close gripping or clamping fit may be achieved whereby no additional fastening members would be required to ensure retention of the base trim member 90 in the position as shown in the drawings.

Adapted to cooperate with the thus positioned base trim member 90 is a top trim member 98 which may be constructed of the same composition as the base trim member 90, or of a contrasting material and it is intended that this top trim member 98 may be readily replaced or exchanged by the ultimate user of the portable wall assembly. The top trim member 98 includes a top wall 98 having a pair of upper angled portions 100 extending downwardly and inwardly from its side edges to form a lockng detent 101 from which depends downwardly and outwardly a lower angled portion 102 and from which further extends an inwardly directed bottom angled flange 103. With the foregoing structure in mind, it will be understood that a top trim member 98 is provided which may be snap-fitted in a downward direction to become securely locked with respect to the base trim member 90, which assembly is achieved merely by moving the top trim member 98 from the position shown in FIGS. 3 and 5 of the drawings downwardly until the bottom angled flanges 103 engage the inside angled walls 95 of the base trim member, at which time continued downward pressure upon the top trim member will cause an inwardly directed deflection of the angled portions of the top trim member until the locking edges 94 of the base trim member have been snap-fitted into the locking detents 101 of the top trim member.

Trim means in the form of a top cap 104 is provided to overlie the top all 77 and at least a portion of the periphery of the retainer upper body 42, and includes a top wall 105 of circular configuration having a depending skirt 106, the interior surface of which provides a close friction fit with the periphery of the retainer upper body 42. To more positively retain the top cap 104 in position atop the retainer 41, a pair of angled tabs 107–107 are diametrically disposed within the interior of the top cap 104 in the area between the juncture of its top wall 105 and skirt 106 and these tabs 107 will be understood to form a close mating fit within a pair of similarly configured radial, inclined slots 108–108 cut into the upper portion of the retainer upper body 42. In the case of the square post embodiment of FIGS. 5 and 6, a top trim cap 109 is provided and includes a square skirt 110 substantially congruent with the exterior dimensions of the square post 75 and which is provided with at least a pair of diametrically opposed tabs 111 configured similar to the tabs 107 and which are intended to cooperate in a close sliding manner with a similar number of diametrically opposed inclined slots 112 formed in the side walls 80 of the square retainer 78.

We claim:

1. A portable wall assembly including, a panel having a vertical end edge, an upright post disposed adjacent said panel end edge for supporting said panel and having an inner cavity at both ends, an edge channel attached to said panel end edge, top and bottom mounting clips each having a mounting leg insertable in the top and bottom of said channel respectively, an arm projecting outwardly from each said clip mounting leg and overlying the respective ends of said post, a tongue extending from each said clip arm into said post cavity, and retainer means releasably attached to both ends of said post and including means overlying said clip arms to secure said clip tongues within said post cavities, wherein, said top clip leg is affixed to said edge channel and said bottom clip leg is loosely disposed within said edge channel and maintained therein by said retainer overlying means.

2. A portable wall assembly according to claim 1 wherein, said post is cylindrical.

3. A portable wall assembly according to claim 1 wherein, said post comprises a rectangular member.

4. A portable wall assembly according to claim 1 wherein, said edge channel includes a transverse base and a pair of side walls each having an inturned flange and defining a channel cavity therebetween normally open at both ends and said clip legs and arms having a transverse extent greater than the distance between said channel flanges.

5. A portable wall assembly according to claim 4 including, an offset projection on each said clip leg having a forward edge engageable with said inturned flanges as said leg engages said transverse base.

6. A portable wall assembly according to claim 4 wherein, said edge channel and post are of substantially similar height and both said clip arms abut the respective ends of said channel inturned flanges and the respective ends of said post when said retainer overlying means are secured.

7. A portable wall assembly according to claim 1 wherein, said retainer means includes an insert fixedly disposed within said post cavity adjacent both ends of said post and said inserts each provided with a horizontal wall spaced inwardly from the post end and having a threaded fastener secured threto.

8. A portable wall assembly according to claim 7 wherein, said insert horizontal wall is provided with a central bore and said threaded fastener includes a nut axially aligned with said bore.

9. A portable wall assembly according to claim 7 wherein, said threaded fastener includes a screw axially extending from said insert horizontal wall and projecting from the respective end of said post.

10. A portable wall assembly according to claim 1 wherein, said top retainer means includes a lower body insertable within said post cavity and having a diameter less than said retainer overlying means.

11. A portable wall assembly according to claim 1 wherein, said bottom retainer means includes a threaded member fixed relative said post bottom end and said retainer overlying means includes a nut/washer engageable with said threaded member.

12. A portable wall assembly according to claim 11 wherein, said threaded member extends downwardly substantially below the bottom of said post and panel and is provided with a central bore having internal threads, and a glide having a screw insertable within said threaded bore and adjustable therewith to vary the elevation of said post and attached panel.

13. A portable wall assembly according to claim 1 including, removable trim means engageable with the top of said panel.

14. A portable wall assembly according to claim 13 wherein, said panel includes a channel along its top edge, a base trim member having locking means disposed within said panel top channel, and said removable trim means includes a top trim member having snap-fitting means engageable with said base trim member locking means.

15. A portable wall assembly according to claim 1 including separate removable trim means overlying and engageable with the top of said top retainer means.

16. A portable wall assembly according to claim 15 wherein, said retainer overlying means engaging said top mounting clip includes an upper body having a slot in its periphery, and said retainer removable trim means comprises a top cap having a skirt and and an interior tab engageable within said slot when said skirt flushly engages the periphery of said retainer upper body.

17. A portable wall assembly according to claim 1 wherein, said edge channel includes a pair of side walls projecting outwardly from said panel end edge and each provided with a plurality of spaced apart slots, and a flexible insert disposed within said channel.

18. A portable wall assembly including, a panel having a vertical end edge, an upright post having top and bottom edges and disposed adjacent said panel end edge for supporting said panel, said post including at both ends an inner cavity distally bounded by said post top and bottom edges respectively, an edge channel attached to said panel end edge, top and bottom mounting clips each having a mounting leg insertable in the top and bottom of said channel respectively, an arm projecting outwardly from each said clip mounting leg toward said post, said clip arms overlying and engaging the respective top and bottom edges of said post, a tongue extending downwardly from said top clip arm into the adjacent said post cavity, a tongue extending upwardly from said bottom clip arm into the adjacent said post cavity, and retainer means releasably attached to both ends of said post and including means overlying said clip arms to secure said clip tongues within said post cavities.

19. A portable wall assembly according to claim 18 wherein, said retainer means include an insert fixedly disposed within said post cavity adjacent both ends of said post and said inserts each provided with a horizontal wall spaced inwardly from the post end and having a threaded fastener secured thereto.

* * * * *